US008615969B2

(12) United States Patent
Suzuki

(10) Patent No.: US 8,615,969 B2
(45) Date of Patent: Dec. 31, 2013

(54) REINFORCEMENT STRUCTURE OF RECTANGULAR FLAT METAL PLATE

(75) Inventor: Toshiro Suzuki, Kawasaki (JP)

(73) Assignees: Suzuki Laboratory of Material and Structure Co. Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 0 days.

(21) Appl. No.: 13/634,575

(22) PCT Filed: Mar. 16, 2011

(86) PCT No.: PCT/JP2011/056181

§ 371 (c)(1),
(2), (4) Date: Sep. 13, 2012

(87) PCT Pub. No.: WO2011/115160

PCT Pub. Date: Sep. 22, 2011

(65) Prior Publication Data

US 2013/0014457 A1 Jan. 17, 2013

(30) Foreign Application Priority Data

Mar. 16, 2010 (JP) ..... 2010-058838

(51) Int. Cl.
*E04C 2/08* (2006.01)

(52) U.S. Cl.
USPC ..... 52/782.1; 52/783.11; 52/783.14; 52/783.19; 52/800.1; 52/223.6

(58) Field of Classification Search
USPC ..... 52/222, 223.1, 223.6, 630, 854, 782.1, 52/783.11, 783.14, 783.19, 798.1, 800.1, 52/800.12, 800.17, 837, 838
See application file for complete search history.

(56) References Cited

U.S. PATENT DOCUMENTS 132,683 A * 10/1872 Munson ..... 52/784.11
140,526 A * 7/1873 Munson ..... 52/783.11

(Continued)

FOREIGN PATENT DOCUMENTS

JP 53-042827 4/1978
JP 05-010000 1/1993

(Continued)

OTHER PUBLICATIONS

International Search Report dated Apr. 26, 2011, issued in corresponding PCT Application No. PCT/JP2011/056181.

(Continued)

*Primary Examiner* — Brian Glessner
*Assistant Examiner* — James Buckle, Jr.
(74) *Attorney, Agent, or Firm* — Kenyon & Kenyon LLP

(57) ABSTRACT

Disclosed is a reinforcement structure of a rectangular flat metal plate, which is provided with: a rectangular flat metal plate that is predominantly subjected to in-plane shear, and supports a compressive load as necessary; strip-like rectangular section members that are spliced in parallel with both side edges of the flat plate in the longitudinal direction so as to reinforce the flat plate; and a plurality of square tube-like members that are parallelly arranged for each constant interval in the shorter side direction of the flat plate, and are spliced on one side surface of the flat plate, or are spliced so as to overlap one another across the flat plate between both surfaces of the front and back of the flat plate, wherein the torsional rigidity and torsional strength of the rectangular flat metal plate are increased to ensure a yield shear load, and shear yield strength can be stably maintained even in the transition of shear deformation after the yield.

6 Claims, 15 Drawing Sheets

(56) References Cited

U.S. PATENT DOCUMENTS

| | | | | | |
|---|---|---|---|---|---|
| 1,365,059 | A | * | 1/1921 | Piccirilli | 52/783.11 |
| 1,636,891 | A | * | 7/1927 | Barrows | 52/782.11 |
| 3,172,509 | A | * | 3/1965 | Dugger | 49/501 |
| 3,280,518 | A | * | 10/1966 | White, Jr. | 52/80.2 |
| 3,426,492 | A | * | 2/1969 | Fork | 52/220.4 |
| 3,534,463 | A | * | 10/1970 | Molin et al. | 228/185 |
| 3,605,370 | A | * | 9/1971 | Prible | 52/783.14 |
| 4,020,989 | A | * | 5/1977 | Kautz | 126/616 |
| D417,737 | S | * | 12/1999 | Stansfield | D25/121 |
| 6,453,638 | B2 | * | 9/2002 | Chen | 52/784.15 |
| 6,513,292 | B2 | * | 2/2003 | Kumon | 52/309.9 |
| 7,090,911 | B2 | * | 8/2006 | Lascelles | 428/163 |
| 7,194,846 | B2 | * | 3/2007 | Swiszcz et al. | 52/793.11 |
| 7,207,151 | B2 | * | 4/2007 | Swiszcz et al. | 52/793.11 |
| 7,854,102 | B2 | * | 12/2010 | Zappa | 52/784.1 |
| 7,921,562 | B2 | * | 4/2011 | Kiji et al. | 29/897 |
| 8,042,315 | B2 | * | 10/2011 | Ashton et al. | 52/783.19 |
| 8,176,708 | B2 | * | 5/2012 | Nozaki | 52/783.17 |
| 2009/0019809 | A1 | * | 1/2009 | Kiji et al. | 52/630 |
| 2010/0115881 | A1 | * | 5/2010 | Inose et al. | 52/783.14 |

FOREIGN PATENT DOCUMENTS

| | | |
|---|---|---|
| JP | 10-246026 | 9/1998 |
| JP | 2004-270208 | 9/2004 |
| JP | 2005-042423 | 2/2005 |
| JP | 2006-037586 | 2/2006 |
| JP | 2008-008364 | 1/2008 |
| JP | 2009-138480 | 6/2009 |
| JP | 2009-161984 | 7/2009 |
| JP | 2009-293254 | 12/2009 |

OTHER PUBLICATIONS

Kihara, Hiromi & Torii, Shingo: "Design of vibration control structure using a steel plate wall made of extremely-low yield point steel," Steel Technology, Nov. 1998, with a partial English translation thereof.

Suzuki, Toshirou: "Shear rigidity including torsional rigidity as main item and shear buckling of flat plate," Architectural Institute of Japan, Sep. 2008, with an English translation thereof.

* cited by examiner

REINFORCEMENT STRUCTURE OF RECTANGULAR FLAT METAL PLATE

TECHNICAL FIELD

The present invention relates to a reinforcement structure of a rectangular flat metal plate that is subjected to in-plane shear and supports a compressive load as necessary and forms the entirety or a part of a panel forming a wall surface of a metal building and an intermediate post type panel or structural wall that is to control or is resistant to vibration. Since a shear force and a shear deformation angle of a flat plate are directly related with the torsional rigidity of the flat plate, the mechanical characteristics of a rectangular flat metal plate subjected to in-plane shear are significantly improved by an increase of torsional rigidity, that is, shear rigidity as an important point of reinforcement.

This application is a national stage application of International Application No. PCT/JP2011/056181, filed Mar. 16, 2011, which claims priority to Japanese Patent Application No. 2010-58838, filed Mar. 16, 2010, the content of which is incorporated herein by reference.

BACKGROUND ART

Even though a shear buckling load is set to exceed a shear yield load, the shear yield strength of a flat metal plate subjected to a shear force is maintained while the shear deformation of the flat metal plate after shear yield progresses. Further, it is difficult to make the flat metal plate have stable hysteresis against a shear load that is repeated in a positive-negative alternating manner. For this reason, it is necessary to reduce the width-thickness ratio of a flat plate that is subjected to a shear force. In the event, a method of segmenting and reinforcing the entire area of a flat plate by disposing many stiffeners in a lattice shape was a method typically used in the past.

To ensure a yield shear load of a flat metal plate and maintain shear yield strength after yield, there is a method of avoiding early shear buckling and improving plastic deformation capacity after yield by increasing the thickness of a flat metal plate using a material of which yield stress is low against shear strength required in design. In addition, various proposals, such as a method of making a shear panel with a corrugated plate or a folded plate for the control of or resistance to vibration, a wall plate into which a viscoelastic material is incorporated, and a method of joining a wall plate to a portion of a building, have been devised.

PRIOR ART DOCUMENTS

Patent Documents

Patent Document 1: Japanese Unexamined Patent Application, First Publication No. H10-246026

Patent Document 2: Japanese Unexamined Patent Application, First Publication No. 2005-042423

Patent Document 3: Japanese Unexamined Patent Application, First Publication No. 2006-037586

Patent Document 4: Japanese Unexamined Patent Application, First Publication No. 2009-161984

Patent Document 5: Japanese Unexamined Patent Application, First Publication No. 2009-293254

Non-Patent Documents

Non-patent Document 1: "Design of vibration control structure using a steel plate wall made of extremely-low yield point steel" written by Hiromi Kihara/Shingo Torii, Steel Technology, November 1998

Non-patent Document 2: "Shear rigidity including torsional rigidity as main item and shear buckling of flat plate" written by Toshirou Suzuki, Architectural Institute of Japan, September 2008

SUMMARY OF INVENTION

Problem to be Solved by the Invention

Objects to be achieved are to ensure a yield shear load of a rectangular flat metal plate, which is subjected to in-plane shear and supports a compressive load as necessary, by significantly increasing the shear rigidity of the rectangular flat metal plate, to stably maintain shear yield strength without the reduction of shear yield strength even in a shearing large-deformation area after yield by increasing the plastic shear load of the flat plate, and to significantly improve the plastic deformation capacity of the rectangular flat metal plate.

Means for Solving the Problem

Since a shear force and a shear deformation angle of a rectangular flat metal plate that is subjected to in-plane shear and supports a compressive load as necessary, are related with Saint Venant torsion rigidity, square tube-like members having a closed cross-section are spliced on the flat plate to increase torsional rigidity, that is, shear rigidity, to ensure a shear yield load of the rectangular flat metal plate, and to stably maintain shear yield strength after yield.

A reinforcement structure of a rectangular flat metal plate according to a first aspect of the invention is provided with: a rectangular flat metal plate that is predominantly subjected to in-plane shear and supports a compressive load as necessary; strip-like rectangular section members that are spliced in parallel with both side edges of the flat plate in the longitudinal direction so as to reinforce the flat plate; and a plurality of square tube-like members that are parallelly arranged for each constant interval in the shorter side direction of the flat plate, and are spliced on one side surface of the flat plate, or are spliced so as to overlap one another across the flat plate between both surfaces of the front and back of the flat plate. The torsional rigidity and torsional strength of the rectangular flat metal plate are increased to ensure a yield shear load, and shear yield strength can be stably maintained even in the transition of shear deformation after the yield.

A reinforcement structure of a rectangular flat metal plate according to a second aspect of the invention is provided with: a rectangular flat metal plate that is predominantly subjected to in-plane shear and supports a compressive load as necessary; strip-like rectangular section members that are spliced in parallel with both side edges of the flat plate in the longitudinal direction so as to reinforce the flat plate; and a plurality of C-shaped section members, semicircular tube-like members, or the like that are disposed in the shorter side direction of the flat plate, are spliced on one surface or both front and back surfaces of the flat plate so as to form a tube-like cavity portion on the flat plate and have substantially the same mechanical characteristics as a square tube-like member. The torsional rigidity and torsional strength of the rectangular flat metal plate are increased to ensure a yield shear load, and shear yield strength can be stably maintained even in the transition of shear deformation after yield.

A reinforcement structure of a rectangular flat metal plate according to a third aspect of the invention is provided with: a rectangular flat metal plate that is predominantly subjected to in-plane shear and supports a compressive load as necessary; square tube-like members that are spliced on both front and back surfaces of the flat plate in parallel with both side edges of the flat plate in the longitudinal direction so as to reinforce the flat plate; and a plurality of square tube-like members that are arranged in parallel for each constant interval between the members in a shorter side direction of the flat plate, and are spliced on one side surface of the flat plate or are spliced on both front and back surfaces of the flat plate so as to overlap the flat plate. The torsional rigidity and torsional strength of the rectangular flat metal plate are increased to ensure a yield shear load, and shear yield strength can be stably maintained even in the transition of shear deformation after yield.

In the reinforcement structure of a rectangular flat metal plate according to the aspect of the invention, the square tube-like members may be parallelly arranged in the longitudinal direction of the rectangular flat metal plate, which is subjected to in-plane shear and supports a compressive load as necessary, so that a substantive difference is generated between the thickness of a portion on which the member is spliced and the thickness of a portion on which the member is not spliced; a width-thickness ratio of the strip-shaped area in the shorter side direction may be 60 or less as for a steel material and may be 40 or less as for a light metal material since a shear yield area is limited to a thin strip-shaped area at an early yield time; and an elastic area may be made to remain within the surface of the flat plate in the form of a layer so that mechanical characteristics are stably maintained even with changes of elastic and plastic rigidities.

In the reinforcement structure of a rectangular flat metal plate according to the aspect of the invention, reinforcing jigs, which apply a shear force, provided on both end portions of the rectangular flat metal plate, which is predominantly subjected to in-plane shear and supports a compressive load as necessary, in a longitudinal direction and the square tube-like members spliced on the flat plate may not be integrated with a small gap interposed therebetween, and may be subjected to transition without hindering the progress of the shear deformation of the flat plate, so that an excessive strength increase exceeding shear yield strength is prevented even in the growth of shear deformation after the shear yield of the rectangular flat metal plate and shear yield strength after the yield is stably maintained.

In the reinforcement structure of a rectangular flat metal plate according to the aspect of the invention, the cross-sections of strip-like rectangular section members or square tube-like members, which suppress rotational deformation to the outside of the flat plate at load application portions in the vicinity of both upper and lower end portions of a rectangular flat metal plate that is predominantly subjected to in-plane shear and supports a compressive load as necessary, allow deformation to the outside of both side edge portions of the flat plate in a long side direction without restricting the torsional deformation of the flat plate, which occur from basic mechanical balance by in-plane shear, and are spliced on both side edge portions of the flat plate in the longitudinal direction, may be increased in size so as to suppress the torsional deformation of the flat plate to a low level and ensure mechanical stability.

Advantageous Effects of Invention

FIG. 2 (*a*) is a perspective view of a square tube-like member that is twisted. FIG. 2 (*b*) shows a torsional force and the flow of shear stress in the section of a square tube, and a torsional force and the flow of shear stress in a rectangular section by way of comparison. Even though component plate elements of a closed cross-section are thin, the product of shear stress flowing in the flat plate and a distance from the center of torsion corresponds to a torsional force. Accordingly, the torsional strength of the square tube is determined depending on the external dimensions of the cross-section, and is set to a very large value since the center line of the plate in the thickness direction is different from the torsional strength of the flat plate that is the center of torsion.

Expression (1) represents a plastic torsional load of a square tube-like member having a square sectional shape, and Expression (2) for comparison represents a plastic torsional load of one plate element forming the section. A ratio of the plastic torsional load of the square tube-like member to four component plate elements is represented in Expression (3), and a plastic torsional load of the section of the square tube having a square sectional shape is about the double of a numerical value of a width-thickness ratio of the plate element. Expression (4) represents the thickness of the plate when the section of the square tube-like member, which is induced from the contrast between FIGS. 2A and 2B, is converted into a rectangular section.

[Expression 1]

$$Q_y = 2(B-t)^2 t\tau_y \tag{1}$$

$$q_y = \left(\frac{t}{2}\right)^2 (B-t)\tau_y \tag{2}$$

$$\alpha = \frac{Q_y}{4q_y} = \frac{2(B-t)}{t} \tag{3}$$

$$T = \sqrt{\frac{2(B-t)}{t}} \tag{4}$$

$\tau_y$: Shear yield stress $Q_y$: Plastic torsional load of square tube-like member $q_y$: Plastic torsional load of component plate element In FIG. 3, square tubes of which the external dimension is 150 mm or less are selected from a list of construction steel materials, and a width-thickness ratio B/t of a plate element forming a section is represented on a horizontal axis and a ratio $Q_y/q_y$ of the plastic torsional load of the square tube to the plastic torsional load of the plate element is represented on a vertical axis. ● marks, which are distributed in the form of an oblique line, correspond to the case of a square section, and 30 samples, which have dimensions between the dimensions of a member of which the length of one side of the square section perpendicular to the longitudinal direction is 50 mm and the thickness is 1.6 mm at a minimum and the dimensions of a member of which the length of one side of the square section perpendicular to the longitudinal direction is 150 mm and the thickness is 12 mm at a maximum, are selected. In this case, a numerical value of about double of the width-thickness ratio of the plate element corresponds to a plastic torsional load. ○ marks correspond to the case of an arbitrary rectangular section, and 24 samples, which have dimensions between the dimensions of a square tube-like member of which the lengths of long and short sides of the rectangular section perpendicular to the longitudinal direction are 60 mm and 30 mm and the thickness is 1.6 mm at a minimum and the dimensions of a square tube-like member of which the lengths of long and short sides of the rectangular section perpendicular to the longitudinal direction are 150 mm and 100 mm and the thickness is 19.0 mm at a maximum, are selected. In this case, ○ marks are dispersed so as to correspond to a numerical value of about 1.5 times in the relationship between a width-thickness ratio of a long side and a plastic torsional load. When the plastic torsional load of a square tube-like member is converted into the thickness of a rectangular section, the thickness of a rectangular section corresponds to 10 to 20 times of the thickness of a square tube as shown by arrows of FIG. 3 along the vertical axis of FIG. 3.

A main object of the reinforcement structure of a flat metal plate according to the invention is to maintain stable shear yield strength after shear yield. Accordingly, since it is necessary to significantly increase the plastic torsional load of a flat metal plate, a square tube-like member is selected as a reinforcing member. Since a portion forming a closed cross-section is formed in the flat metal plate, it is possible to significantly increase torsional rigidity and torsional strength even in the case of a thin flat plate. Therefore, it is possible to significantly improve the mechanical characteristics of a rectangular flat metal plate that is subjected to in-plane shear.

MODE FOR CARRYING OUT THE INVENTION

Figure 1:
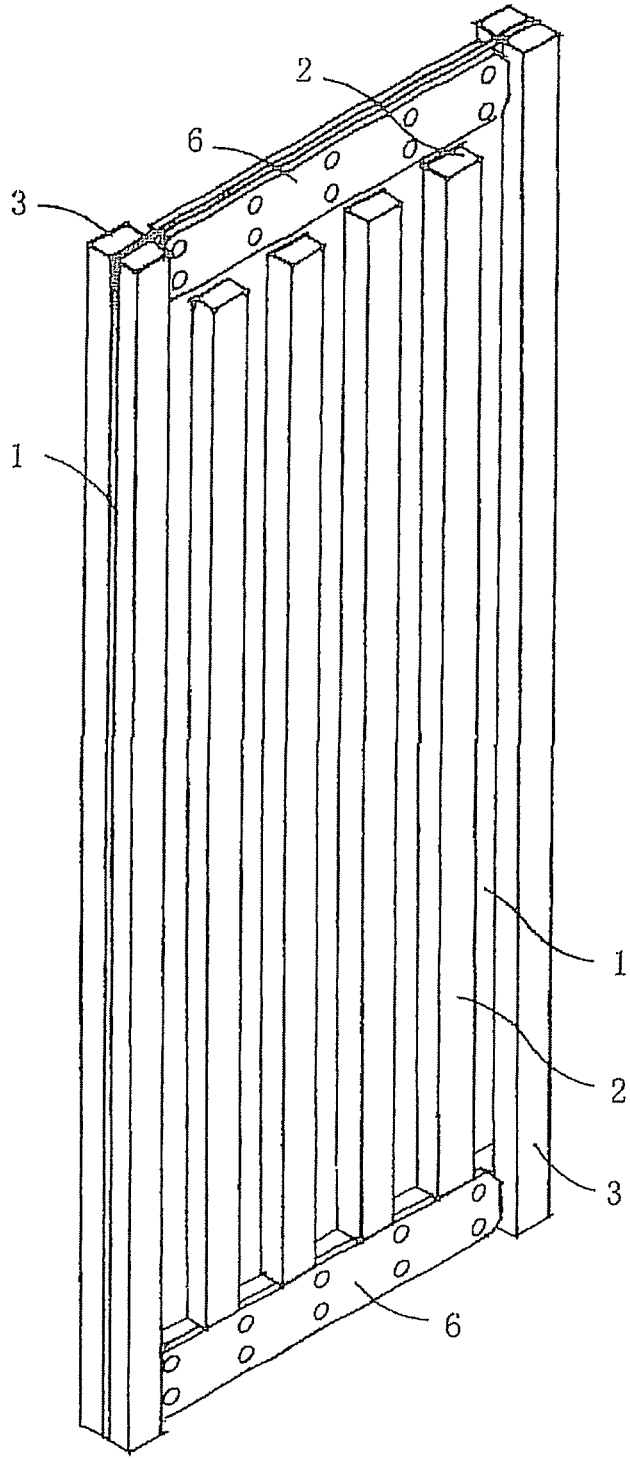
FIG. 1 is a perspective view showing a reinforcement structure that reinforces a rectangular flat metal plate with square tube-like members.
Figure 2:
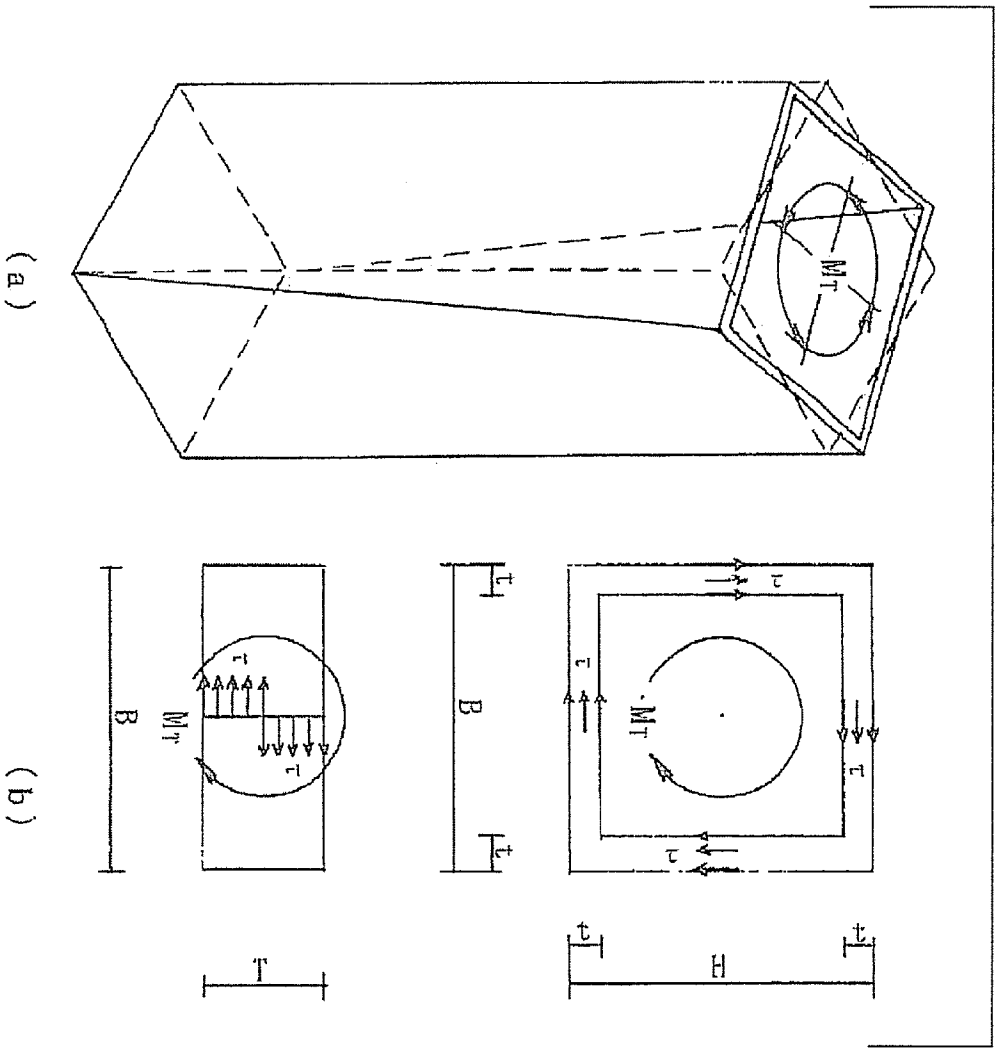
FIG. 2 is a view showing the torsion of a square tube-like member and the flow of shear stress in a closed cross-section.
Figure 3:
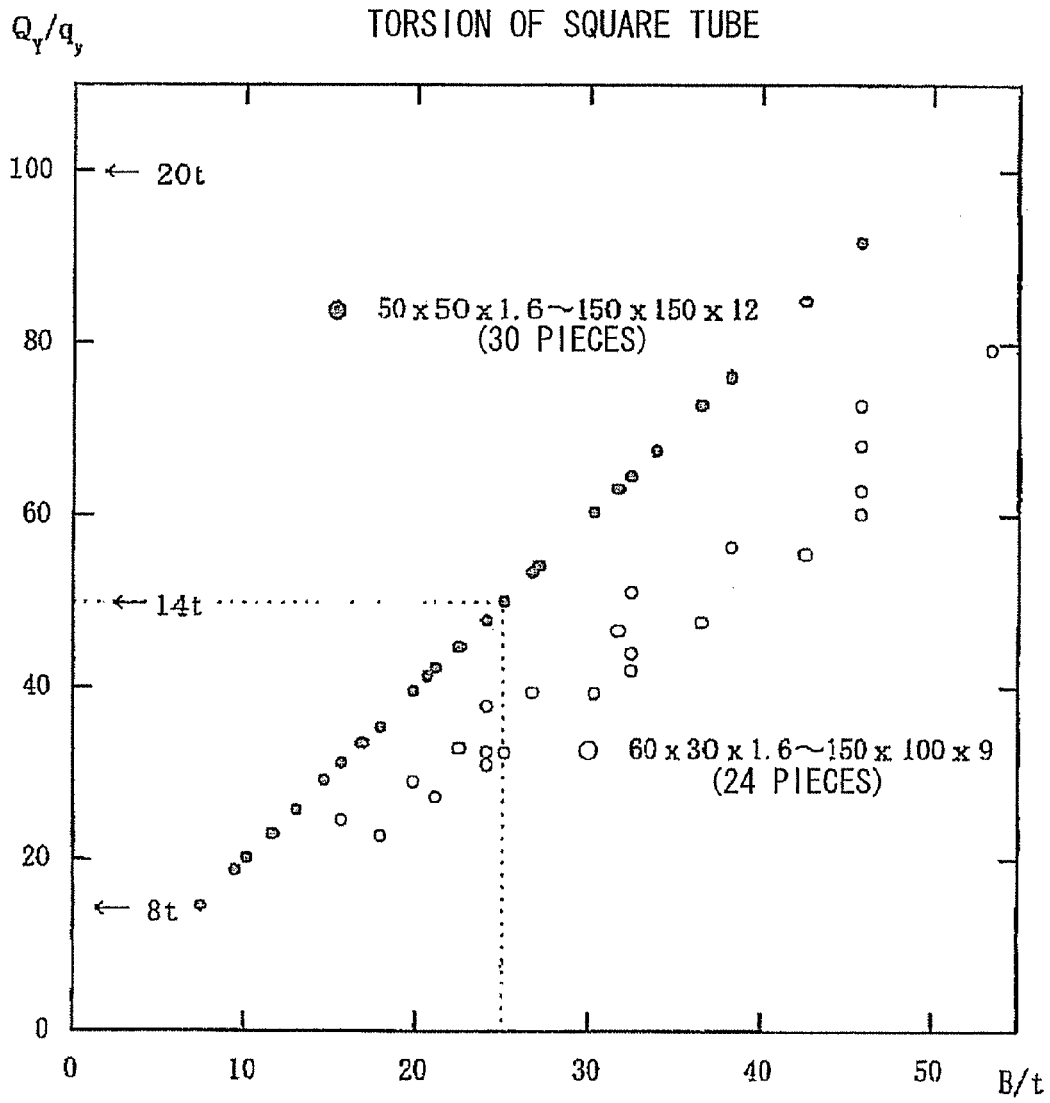
FIG. 3 is a view showing a relationship between a plastic torsional load and a cross-section component plate element of a structural square tube-like member.

FIG. 1 is a perspective view showing the typical structure of the invention. A rectangular flat metal plate 1, which is predominantly subjected to in-plane shear, is reinforced with square tube-like members 2 and 3 that are spliced at substantially equal intervals on one surface or both surfaces of the flat plate. The sizes of the members 3, which are provided along both side edges, are set to be larger than the sizes of the members 2 that are disposed inside the members 3 as necessary so that torsional rigidity and torsional strength are increased and the rectangular flat plate is mechanically stable. A shear load is horizontally applied to the vicinity of both upper and lower end portions of the rectangular flat metal plate, but force applying jigs 6 at these portions and the square tube-like members spliced on the flat plate are not structurally integrated with each other.

As the rectangular flat metal plate that is predominantly subjected to in-plane shear and supports a compressive load as necessary, there is a reinforcement structure of a rectangular flat metal plate where a plurality of arbitrary section members such as C-shaped section members are parallelly arranged in the shorter side direction of the flat plate in parallel with side edges of the flat plate in the longitudinal direction of the flat plate so as to be spliced from one surface of the flat plate or the members are spliced on the front and back surfaces so as to overlap the plate and cavity portions surrounded by the flat plate and the members so that the torsional rigidity and torsional strength of the rectangular flat metal plate are significantly increased to ensure a yield shear load of the flat plate and maintain the shear yield strength after the yield.

FIRST EMBODIMENT

Figure 4:
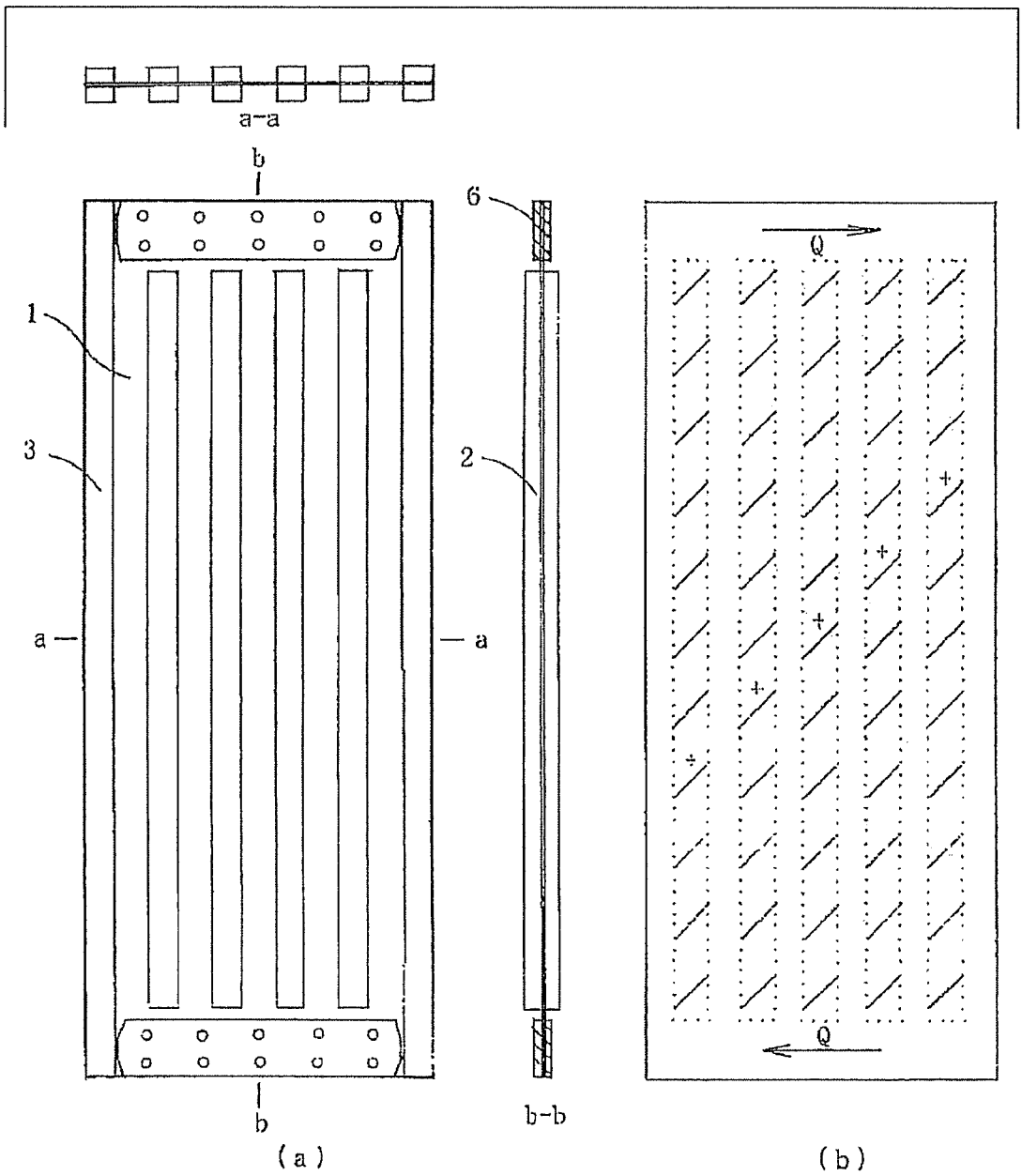
FIG. 4 is a structural diagram of a rectangular flat metal plate that is reinforced with square tube-like members. (First embodiment)

In FIG. 4A, square tube-like members 3 are spliced along both side edges of the rectangular flat metal plate 1 of 2,250 mm×900 mm in a long side direction on both the front and back surfaces of the rectangular flat metal plate, the square tube-like members 2 are spliced from one surface or both surfaces of the flat plate in parallel with the parallel members, and jigs 6, which apply forces, are installed at the upper lower end portions of the flat plate without being integrated with the square tube-like members. Accordingly, the restriction of the members associated with the progress of shear deformation is avoided. Further, FIG. 4B shows the transition of shear stress in the plane of the flat plate, and shear yield occurs first in strip-shaped areas of the flat plate that are interposed between the square tube-like members and shown by a dotted line, oblique tension shown by a solid line is gradually applied, so that shear yield proceeds to a tension field as shown by + marks.

Figure 5:
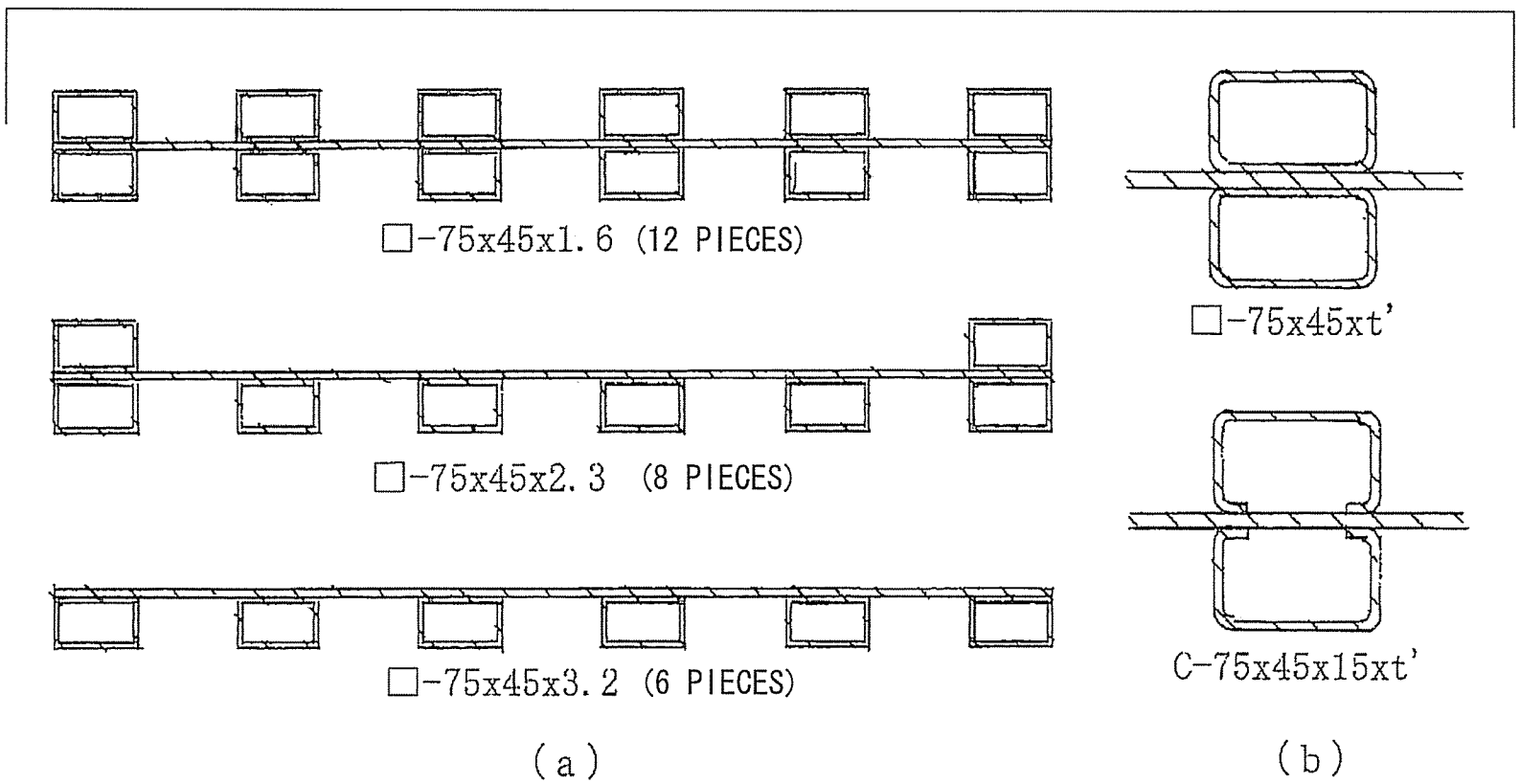
FIG. 5 is a cross-sectional view showing the square tube-like members that are spliced on the front and back surfaces of the flat plate.

FIG. 5 is cross-sectional view showing the disposition of members that are used as analysis objects in order to examine the reinforcing effect of the square tube-like members about the rectangular flat metal plate. An upper stage of FIG. 5 (*a*) shows a case where twelve square tube-like members, of which the lengths of the long and short sides of the rectangular section perpendicular to the longitudinal direction are 75 mm and 45 mm and the thickness is 1.6 mm, reinforce the flat plate so as to overlap both surfaces of the flat plate; an intermediate stage of FIG. 5 (*a*) shows a case where eight square tube-like members, of which the lengths of the long and short sides of the rectangular section perpendicular to the longitudinal direction are 75 mm and 45 mm and the thickness is 2.3 mm, are evenly disposed on one surface of the flat plate and only the edge portions of both sides of the flat plate are also reinforced from the opposite surface; and a lower stage of FIG. 5 (*c*) shows a case where six square tube-like members, of which the lengths of the long and short sides of the rectangular section perpendicular to the longitudinal direction are 75 mm and 45 mm and the thickness is 3.2 mm, are evenly disposed only on one surface of the flat plate and reinforce the flat plate. In the analysis, for the comparison of the reinforcing effects of the respective cases, the thickness of the member is changed so that the total sectional area of the reinforcing members is substantially constant. An upper stage of FIG. 5 (*b*) exemplifies a case where square tube-like members, of which the lengths of the long and short sides are 75 mm and 45 mm and the thickness is t' mm, are used as reinforcing members; and a low stage exemplifies a case where C-shaped section members, of which the lengths of the long and short sides are 75 mm and 45 mm, the length of a portion continuously bent from the short side is 15 mm, and the thickness is t' mm, are used as reinforcing members and mounted on the flat plate so as to cover the flat plate.

Figure 6:
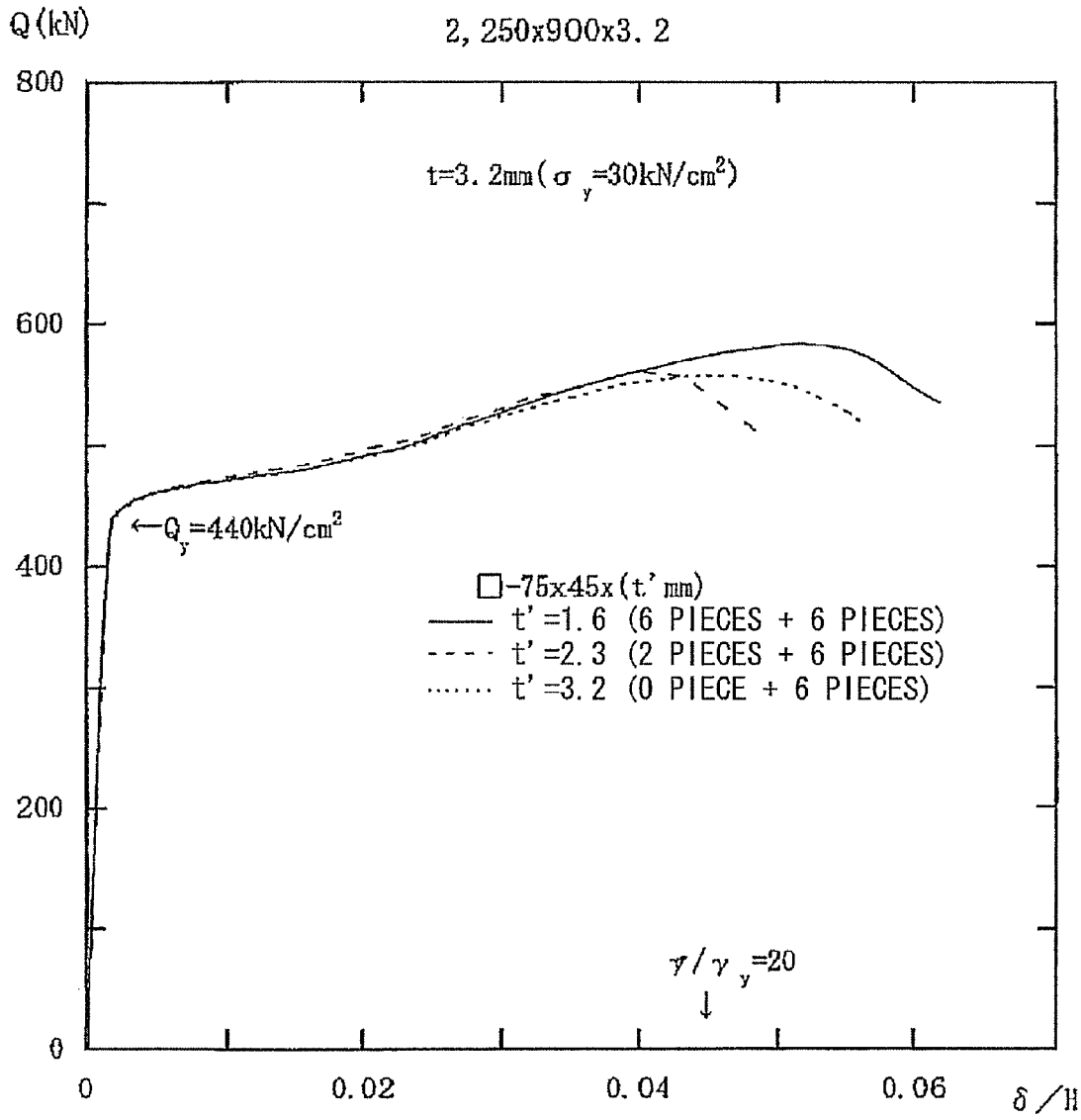
FIG. 6 is a view illustrating analysis results about the arrangement form and the reinforcing effect of the square tube-like members.

FIG. 6 shows numerical analysis results of the rectangular flat plate of which the long side is 2,250 mm, the short side is 900 mm, and the thickness t is 3.2 mm. In FIG. 6, the effects of the reinforcing members are verified when the disposition of the reinforcing members shown on the upper stage of FIG. 5A is employed, when the disposition of the reinforcing members shown on the intermediate stage of FIG. 5A is employed, and when the disposition of the reinforcing members shown on the lower stage of FIG. 5C is employed. A vertical axis of FIG. 6 represents a shear load Q that is made dimensionless with a yield shear load $Q_y$, and δ/H of a horizontal axis represents a ratio of the horizontal displacement δ of the upper portion of a wall plate to the height of the wall plate as a story deformation angle. Taken as a whole, all structures have high plastic deformation capacity. However, in strict comparison, the plastic deformation capacity of the structure where both surfaces of the flat plate are reinforced is slightly superior to the others.

Figure 7:
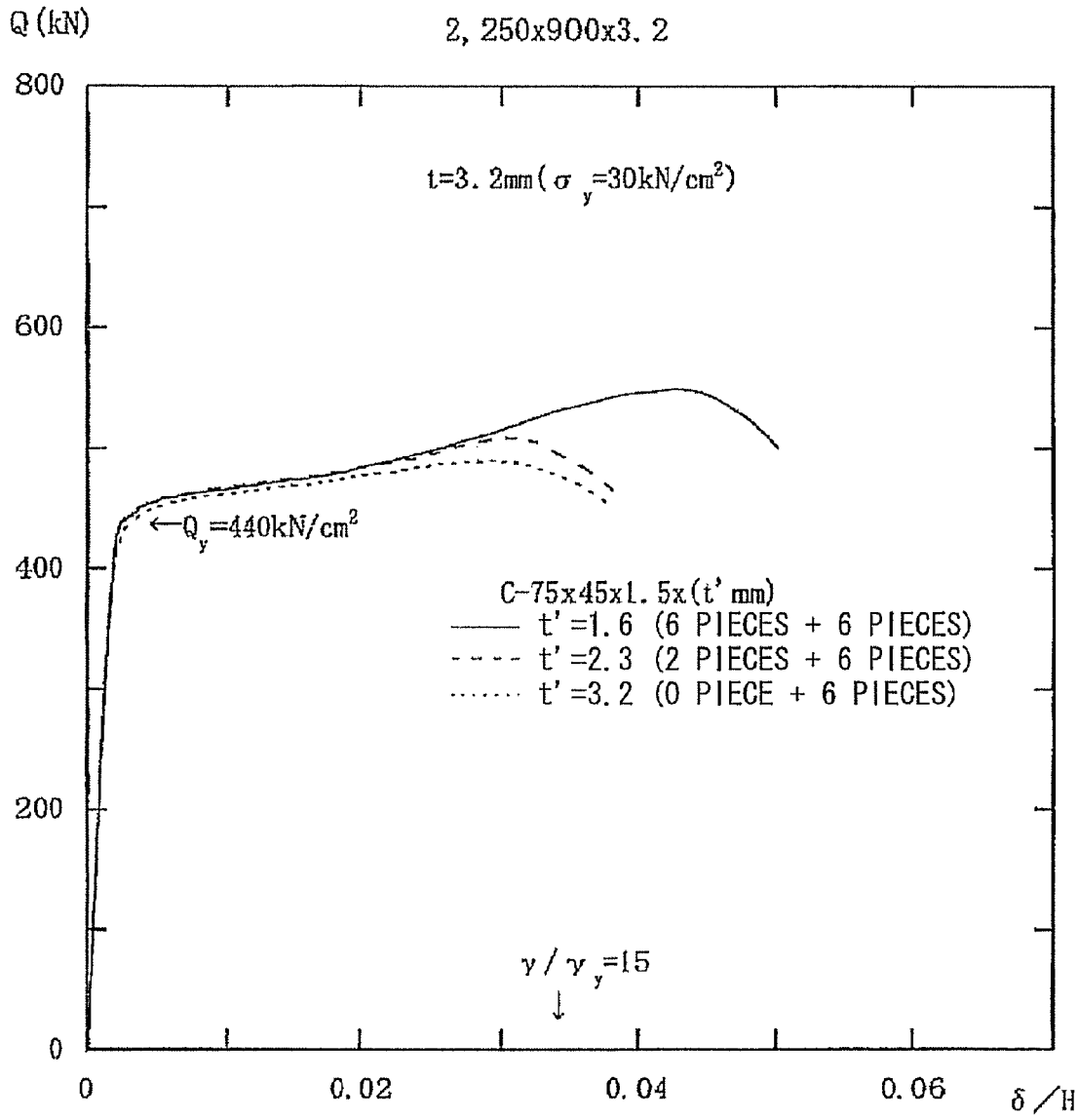
FIG. 7 is a view illustrating analysis results about the reinforcement using C-shaped section members and the effect thereof.

FIG. 7 shows numerical analysis results of the rectangular flat plate of which the long side is 2,250 mm, the short side is 900 mm, and the thickness t is 3.2 mm; and shows numerical analysis results of the rectangular flat plate that is reinforced with the C-shaped section members of FIG. 5 (*b*) as reinforcing members when the disposition of the reinforcing members shown on the upper stage of FIG. 5 (*a*) is employed, when the disposition of the reinforcing members shown on the intermediate stage of FIG. 5 (*a*) is employed, and when the disposition of the reinforcing members shown on the lower stage of FIG. 5 (*c*) is employed. A difference with the square tube-like member corresponds to a case where the section of a portion of the C-shaped section member coming into contact with the flat plate is missing. When the C-shaped section member and the square tube-like member are compared with each other in terms of plastic deformation capacity, the plastic deformation capacity of the C-shaped section member is about ⅔ of that of the square tube-like member. Since torsional rigidity and torsional strength applied to the flat plate are substantially the same, it is considered that this difference is caused by a difference between the thicknesses of the reinforced portions of the flat plate. In the above-mentioned numerical analysis, a material has a yield stress of σy=30 kN/cm$^2$ and is soft steel corresponding to SS400. The following analysis is also performed on this material.

SECOND EMBODIMENT

Figure 8:
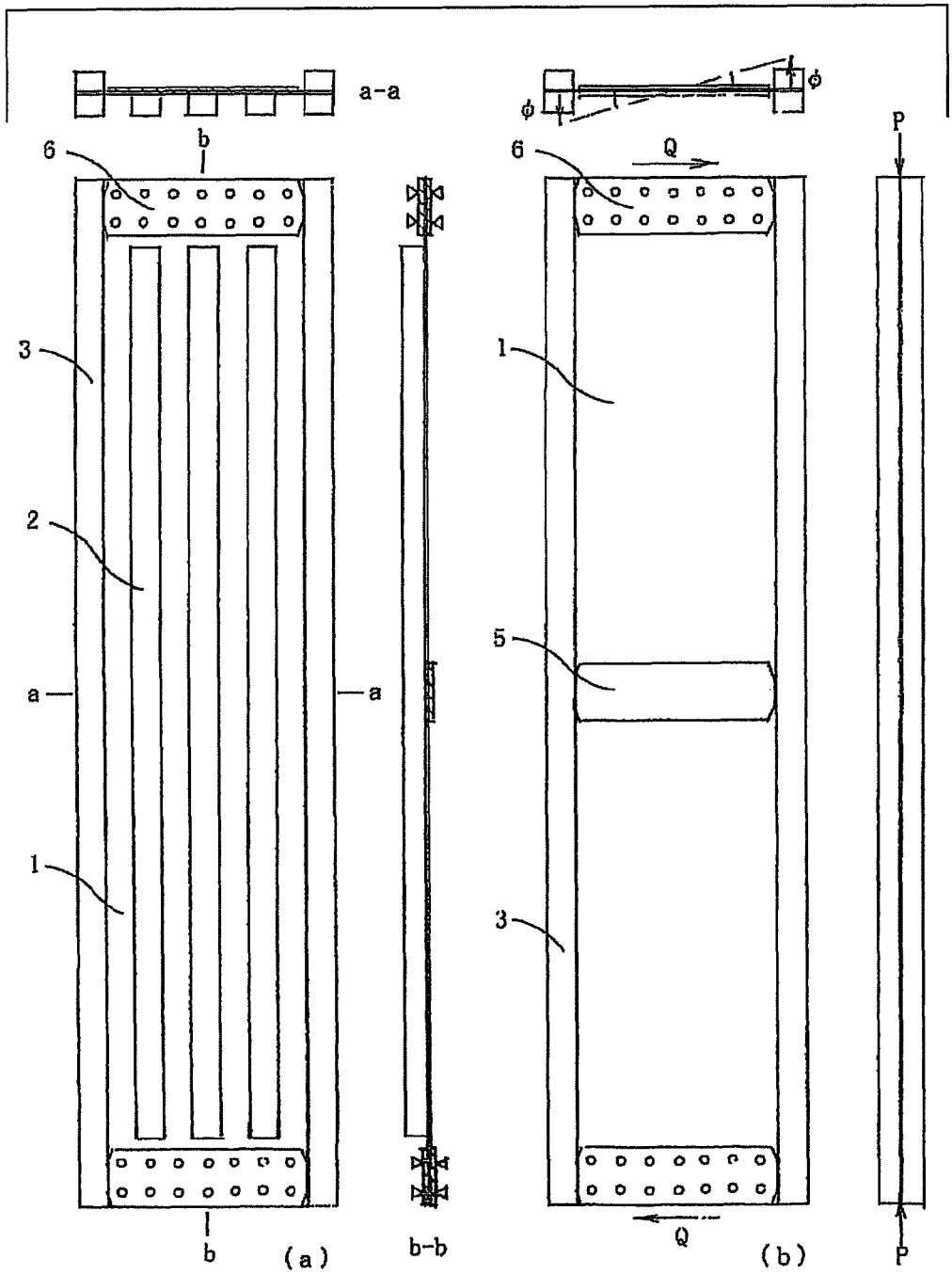
FIG. 8 is a structural diagram of square tube-like members that are spliced on a long column-like flat metal plate. (Second embodiment)

FIG. 8 shows a long column-like shear panel that has a side length ratio of 1:4. When square tube-like members 2 having a width of 100 mm are spliced at an interval of 100 mm on one surface of a rectangular flat metal plate 1 shown in FIG. 8 (*a*), a case where square tube-like members 3 are spliced along both side edges on the other surface shown in FIG. 8 (*b*) and a case where strip-like rectangular section members 4 having a width of 100 mm are spliced along both side edges on the other surface shown in FIG. 8 (*b*) are considered. Even in all the above-mentioned cases, a rectangular section member 5 is provided on the middle portion of the flat plate. Force applying jigs of rectangular section members 6, which are provided at the upper and lower end portions of the flat plate, are slightly separated from the reinforcing members in the long side direction so as not to hinder the progress of shear deformation.

Figure 9:
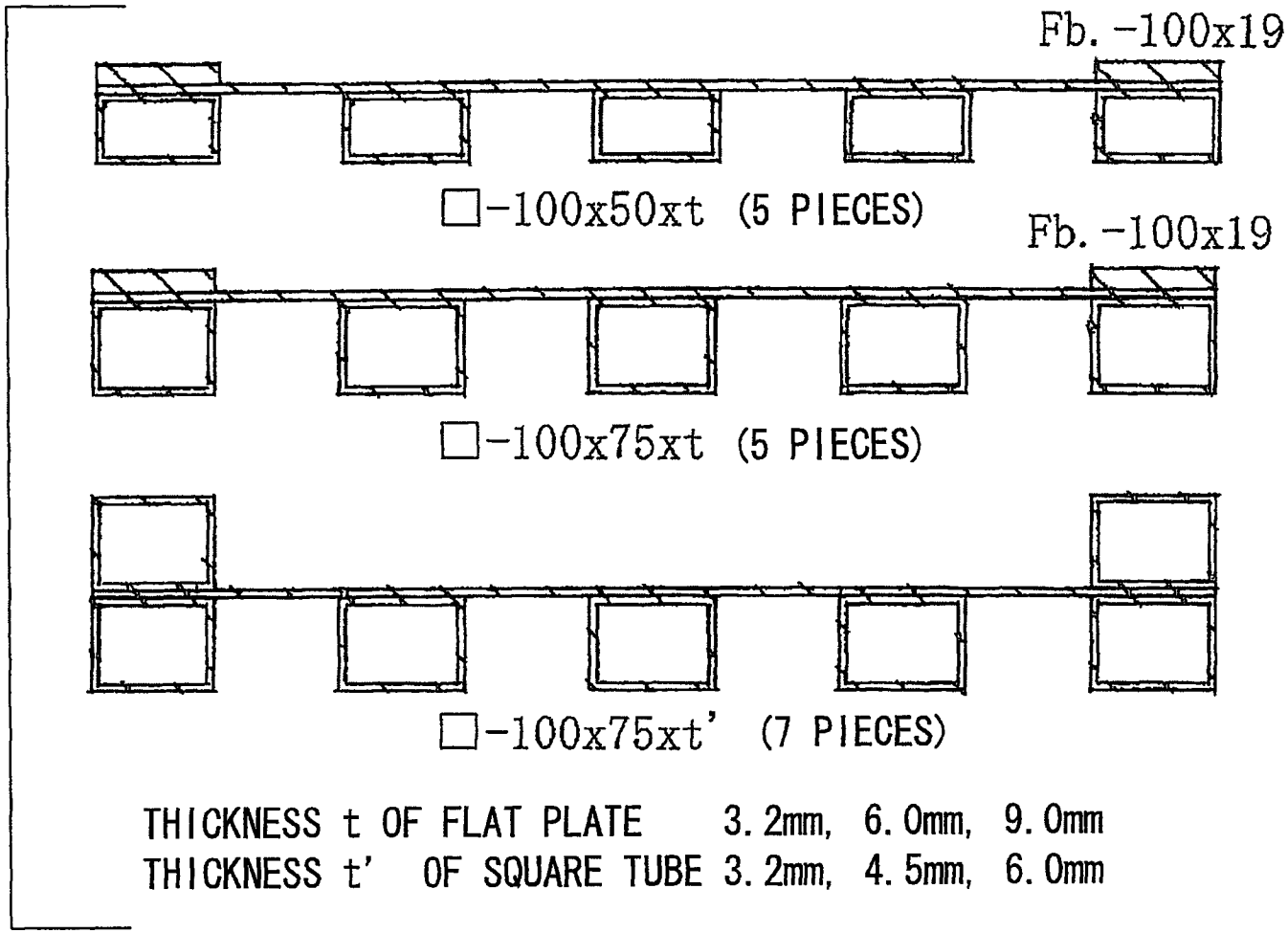
FIG. 9 is a cross-sectional view showing the square tube-like members that are spliced on the front and back surfaces of the flat plate.

In FIG. 9, 3.2 mm, 6.0 mm, and 9.0 mm as the thickness t of the rectangular flat metal plate are selected as analysis examples, and the thicknesses t' of □−100×50×t' (that is, a square tube-like member of which the lengths of the long and short sides of the rectangular section perpendicular to the longitudinal direction are 100 mm and 50 mm and the thickness is t') and □−100×75×t' (that is, a square tube-like member of which the lengths of the long and short sides of the rectangular section perpendicular to the longitudinal direction are 100 mm and 75 mm and the thickness is t') as square tube-like members are set to 3.2 mm, 4.5 mm, and 6.0 mm in the above-mentioned cases. It is devised that the plastic deformation capacities of flat plates, which have different shear yield loads through the change of the thickness t' of the square tube according to the thickness t of the rectangular flat metal plate, are also planned to be substantially the same and overall mechanical characteristics of the flat plate is adjusted for the increase of plastic deformation capacities through the increase of the external dimensions of the square tubes.

Figure 10:
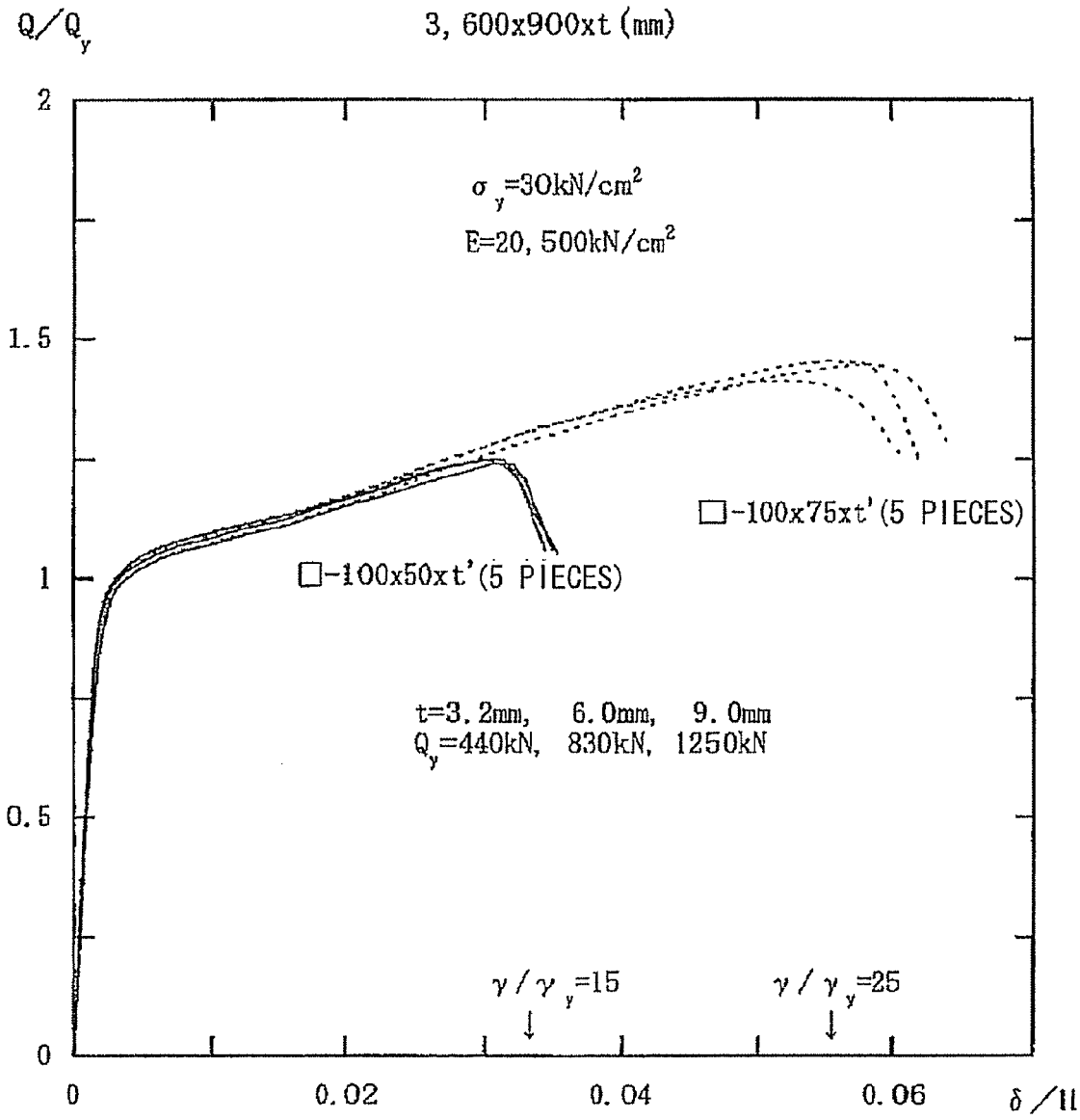
FIG. 10 is a view illustrating analysis results about the plastic deformation capacity of the long column-like flat metal plate.

FIG. 10 is a view illustrating a relationship between a shear load ratio $Q/Q_y$ and a shear deformation angle δ/H when square tube-like members are spliced only on one surface of a rectangular flat metal plate of which the length of the long side is 3,600 mm, the length of the short side is 900 mm, and the thickness is t mm and strip-like rectangular section members having a width of 100 mm are spliced on the other surface along both side edges. A solid line of FIG. 10 corresponds to a case where a tube-like member of □−100×50×t' (that is, a square tube-like member of which the lengths of the long and short sides of the rectangular section perpendicular to the longitudinal direction are 100 mm and 50 mm and the thickness is t') shown on the upper stage of FIG. 9 is employed, and a dotted line corresponds to a case where a tube-like member of □−100×75×t' (that is, a square tube-like member of which the lengths of the long and short sides of the rectangular section perpendicular to the longitudinal direction are 100 mm and 75 mm and the thickness is t') shown on the intermediate stage of FIG. 9 is employed. While the thickness of the square tube is 3.2 mm when the thickness of the rectangular flat metal plate is 3.2 mm, the thickness of the square tube is 4.5 mm when the thickness of the flat metal plate is 6.0 mm, and the thickness of the square tube is 6.0 mm when the thickness of the flat metal plate is 9.0 mm, the thickness t' of the square tube is changed according to the thickness t of the flat metal plate. However, it is possible to ensure substantially the same mechanical characteristics against different shear yield strength without the change of the external dimensions of the flat metal plate, and to adjust plastic deformation capacity by the external dimensions of the section of the square tube. Accordingly, the weight of the reinforcing member corresponding to this is almost the same.

Figure 11:
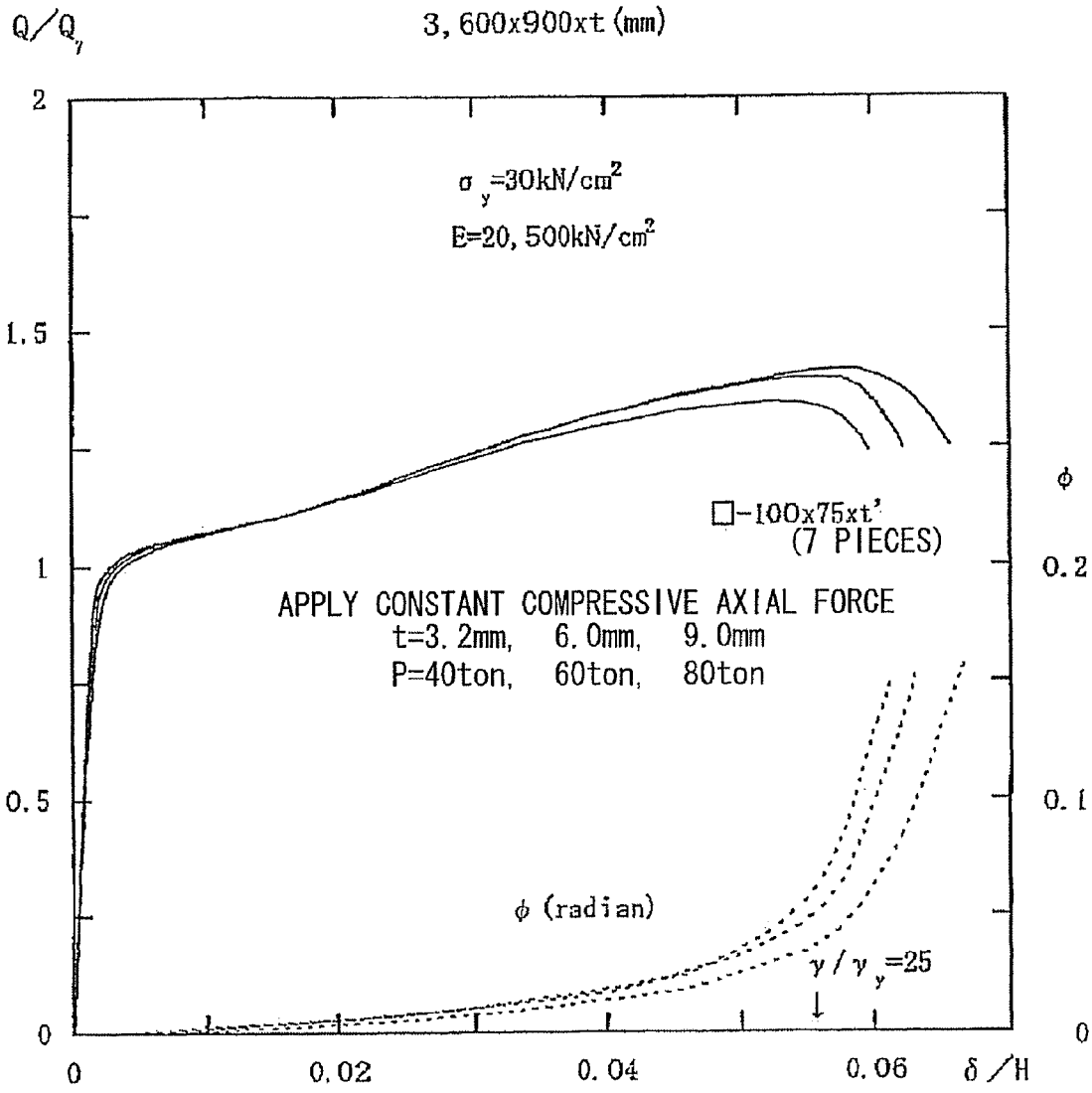
FIG. 11 is a view illustrating analysis results about the long column-like flat metal plate that receives a compressive axial force.

FIG. 11 is a view illustrating a relationship between a shear load ratio $Q/Q_y$ and a shear deformation angle δ/H while a constant compressive axial force P is applied into the plane of a rectangular flat plate when square tube-like members are spliced at regular intervals on one surface of the rectangular flat metal plate of which the length of the long side is 3,600 mm, the length of the short side is 900 mm, and the thickness is t mm and square tube-like members are spliced on the other surface along both side edges. A solid line of FIG. 11 corresponds to a case where a tube-like member of □−100×75×t' (that is, a square tube-like member of which the lengths of the long and short sides of the rectangular section perpendicular to the longitudinal direction are 100 mm and 75 mm and the thickness is t') shown on the lower stage of FIG. 9 is employed. An axial compressive force is an analysis result when about 20% of a yield axial force is set in terms of the total sectional area of the spliced square tubes. A dotted line shown on the lower side in FIG. 11 represents a torsional deformation angle ϕ of the middle portion of the rectangular flat metal plate. The torsional deformation angle ϕ is suppressed to a low degree even when the shear deformation of the flat plate progresses. Under this set condition, it is considered that a structure where square tube-like members overlap the front and back surfaces of the flat plate along both side edges of the flat plate in the longitudinal direction is effective.

THIRD EMBODIMENT

Figure 12:
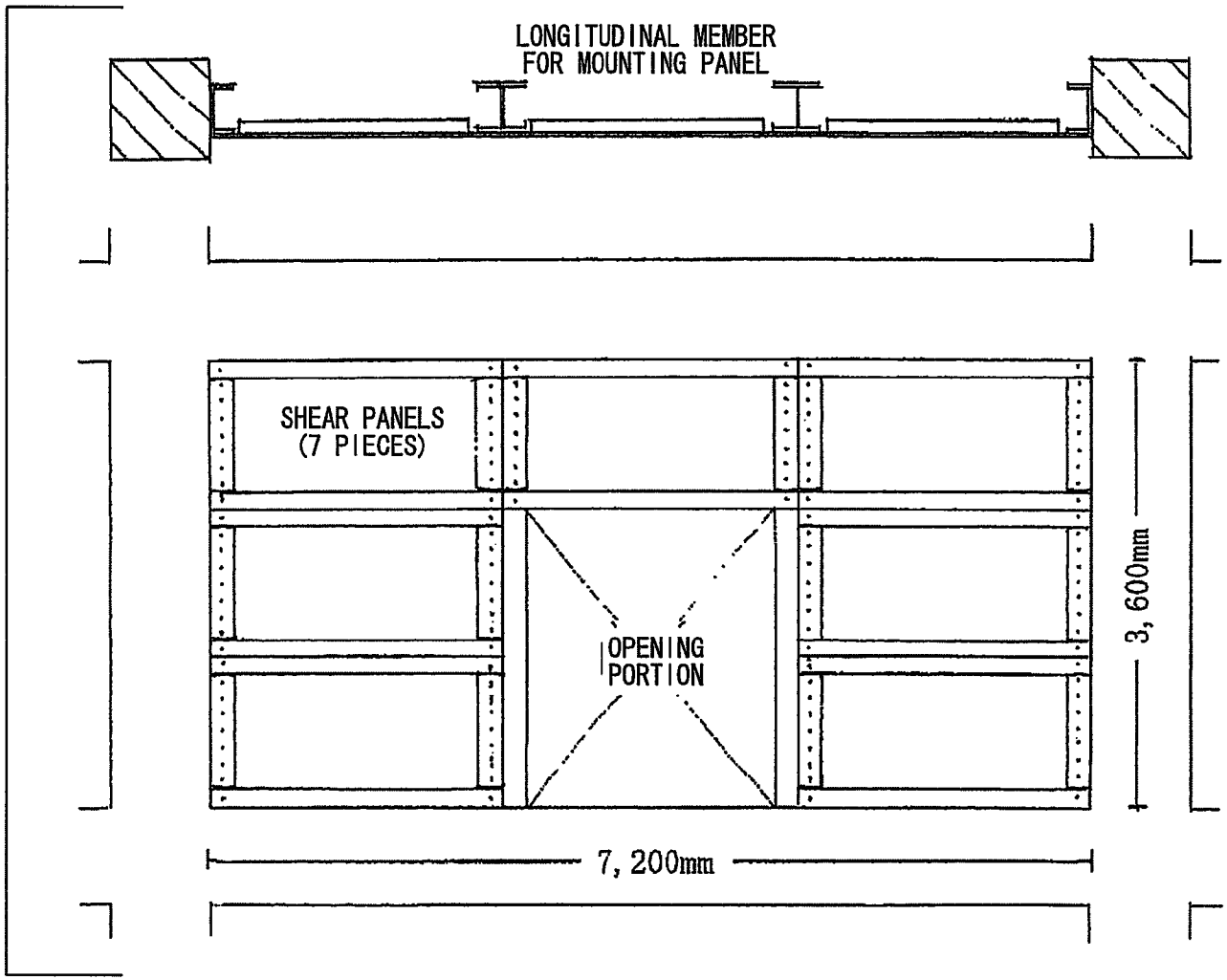
FIG. 12 is a view showing the disposition of a flat metal plate that is assembled on a wall surface including an opening portion. (Third embodiment)

FIG. 12 is a view checking the antiseismic reinforcement of a wall surface that includes an opening portion in a design embodiment as a model premised that the rectangular flat metal plate of the invention is used, and shows the disposition of a plurality of unit rectangular flat metal plates, which are reinforced with square tubes, on a wall surface. Seven reinforcing wall plates of 2,400 mm×1,200 mm are disposed around the opening portion on the wall surface of 7,200 mm×3,600 mm. However, conditions that the mounting of the reinforcing wall plates performed on four longitudinal members at the side edges of the wall surface in the short side direction and the deformation to the outside of the wall surface is not restricted along the side edges in the long side direction are used as design conditions.

Figure 13:
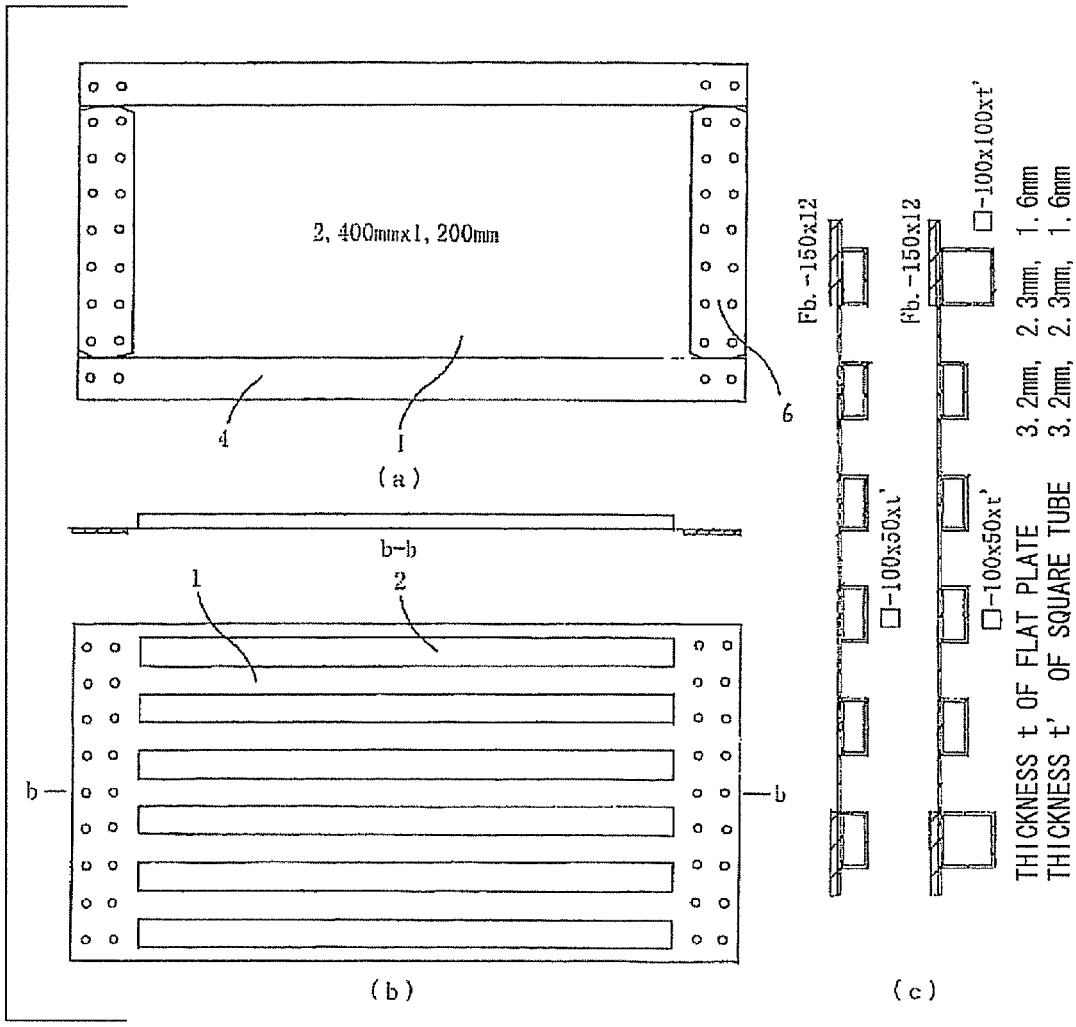
FIG. 13 is a view showing the disposition of a strip plate and square tubes in a thin flat metal plate unit.

FIG. 13 is a view showing a reinforcement structure of a flat metal plate of 2,400 mm×1,200 mm. As shown in FIG. 13 (*a*), strip plates 4 having a rectangular section of 150 mm×12 mm are spliced on one surface of a flat metal plate 1 along side edges in the longitudinal direction and force applying reinforcement jigs 6 are mounted along side edges in the short side direction so as to be separated from the strip plates. As shown in FIG. 13 (*b*), square tube-like members 2 are evenly and parallelly arranged and spliced on the other surface of the flat metal plate 1 so as to be slightly separated from the side edges in the longitudinal direction, and force applying portions are directly fixed to longitudinal members of a building. An upper stage of FIG. 13 (*c*) is an example where □−100×50×t' (that is, a square tube-like member of which the lengths of the long and short sides of the rectangular section perpendicular to the longitudinal direction are 100 mm and 50 mm and the thickness is t') is used as a square tube-like member, and a lower stage of FIG. 13 (*c*) is an example where □−100×100×t' (that is, a square tube-like member of which each of the lengths of two sides, that is, vertical and horizontal sides of the square section perpendicular to the longitudinal direction is 100 mm and the thickness is t') is used as only each of the square tube-like members provided along both side edges.

Figure 14:
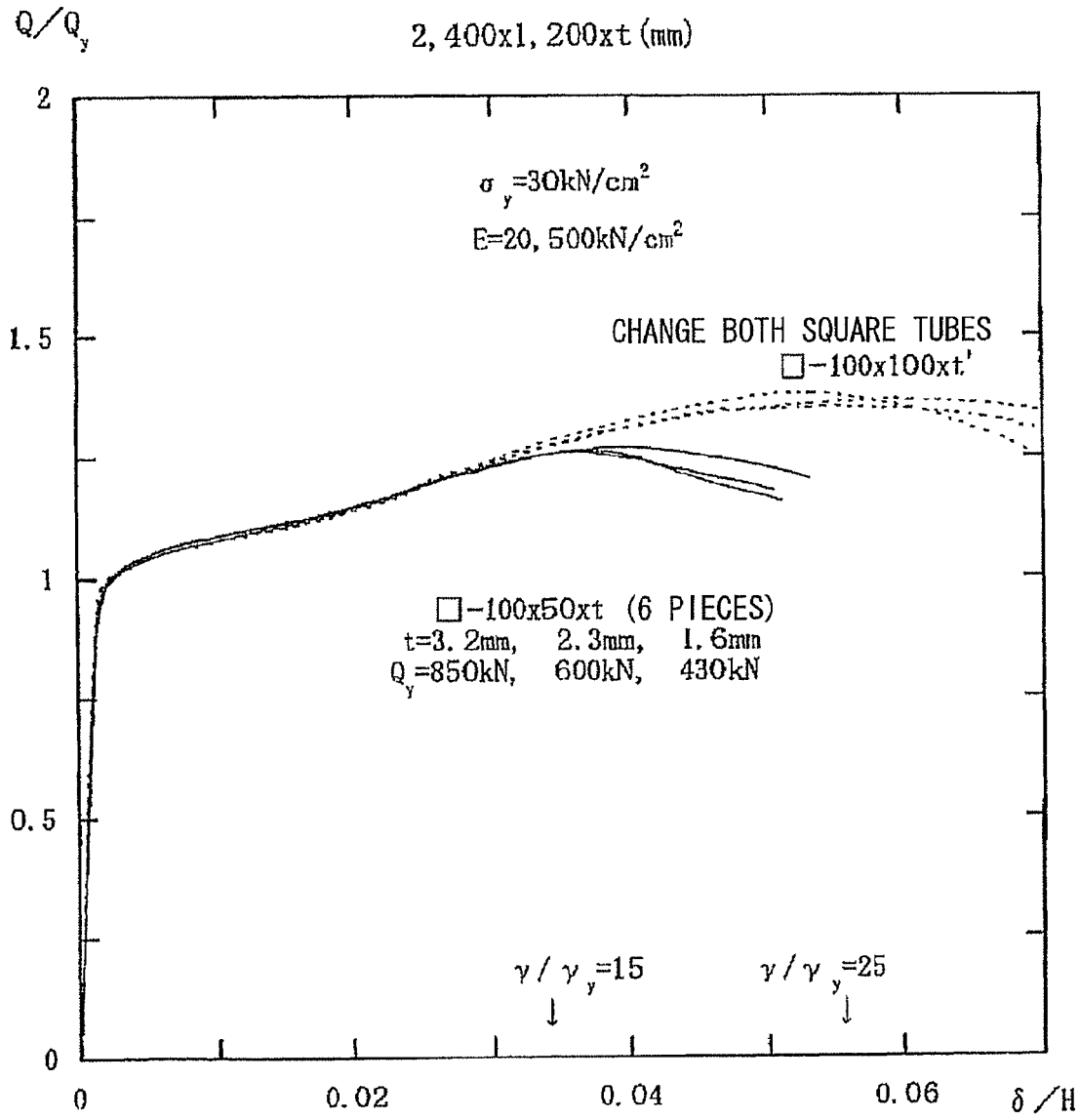
FIG. 14 is a view illustrating analysis results about the plastic deformation capacity of the flat metal plate unit.

FIG. 14 shows numerical analysis results of rectangular flat metal plates of which the long side is 2,400 mm, the short side is 1,200 mm, and the thickness t is 3.2 mm, 2.3 mm, and 1.6 mm. A solid line of FIG. 14 corresponds to a case where the disposition of the reinforcing members shown on the upper stage of FIG. 13 (*c*) is employed and the thickness t' of each of the six square tube-like members (□−100×50×t') is equal to the thickness t of the flat plate, and a dotted line of FIG. 14 corresponds to a case where the disposition of the reinforcing members shown on the lower stage of FIG. 13 (*c*) is employed and the dimensions of only two square tube-like members provided along the side edges are changed into the dimensions of □−100×100×t' (that is, a square tube-like member of which each of the lengths of two sides, that is, vertical and horizontal sides of the square section perpendicular to the longitudinal direction is 100 mm and the thickness is t'). The width of a strip-shaped area, which is formed between the parallelly arranged square tube-like members, in the short side direction is 80 mm, and the limits of shear yield strength of the flat plates after the yield have substantially the same value although the width-thickness ratios of the respective flat plates are 25, 35, and 50.

As for the shear buckling of a semi-infinite flat plate, an elastic shear buckling load is represented in Expression (5), a buckling coefficient is represented in Expression (6), and a width-thickness ratio of the flat plate in the short side direction is represented in Expression (7). It is necessary to ensure a shear yield load when the rectangular flat metal plate is subjected to in-plane shear. Considering that plasticization proceeds at a shear yield starting time in a narrow strip-shaped area interposed between square tube-like members or the like, a condition that the elastic shear buckling load of that portion exceeds a shear yield load is an essential condition.

[Expression 2]

$$\tau_{cr} = \frac{\pi^2 E}{12(1-\nu^2)}\left(\frac{t}{b}\right)^2 k \tag{5}$$

$$k = 8.98 \tag{6}$$

$$\left(\frac{t}{b}\right)^2 = \sqrt{\frac{0.903kE}{\tau_y}} \tag{7}$$

$\tau^{cr}$: Elastic shear buckling stress

E, v: Elastic Young's modulus, Poisson's ratio k: Buckling coefficient of semi-infinite flat plate t/b: Width-thickness ratio when seen in short side direction The rectangular flat metal plate, which is a target of the invention, includes a steel material and a light metal material, and the yield stress of a metal material also falls within a given range of a numerical value. Considering that a yield stress σy of 30 kN/cm$^2$ and a Young's modulus E of 20,500 kN/cm$^2$ are considered as standards about a steel material and a yield stress σy of 20 kN/cm$^2$ and a Young's modulus E of 7,200 kN/cm$^2$ are considered as standards about a light metal material, a width-thickness ratio b/t where an elastic shear buckling load exceeds a shear yield load is 98 as for a steel material and is 69 as for a light metal material. Accordingly, in consideration of irregularity such as deflection of a flat plate, the limit of a width-thickness ratio b/t of a steel material is set to 60 and the limit of a width-thickness ratio b/t of a light metal material is set to 40 so that the width-thickness ratio becomes about ⅔ or less of the above-mentioned numerical value.

INDUSTRIAL APPLICABILITY

The typical structure of the invention is shown in the perspective view of FIG. 1, but square tube-like members are spliced at substantially equal intervals on one surface or both surfaces of a rectangular flat metal plate that is predominantly subjected to in-plane shear. Fillet welding or mounting using a metal adhesive are considered as standards for the flat plate. However, when square tube-like members provided on one surface of the flat plate overlap the square tube-like members or strip-like rectangular section members provided on the other surface of the flat plate, the members may be joined to each other by bolts with the flat plate interposed between the members. There are advantages in that the reinforcement structure for reinforcing a rectangular flat metal plate with square tube-like members is relatively simply assembled, is light, and has easiness in design and simplicity in production.

The invention proposes a reinforcement structure of a rectangular flat metal plate that is subjected to in-plane shear and supports a compressive load as necessary. A square tube-like member, which has a closed cross-section, of the reinforcement structure effectively contributes to ensuring mechanical characteristics including torsion as a main item, and the reinforcement structure is optimal as a panel forming the wall surface of a metal building and a shear panel that is to control or resistant to vibration. The flat metal plate has a yield stress $\sigma y$ of 30 kN/cm$^2$ and a Young's modulus E of 20,500 kN/cm$^2$ in the embodiments described in the specification. However, it can correspond to steel having a high yield point and steel having a low yield point, and to also correspond to a light metal material in the same way in consideration of a difference in Young's modulus.

Figure 15:
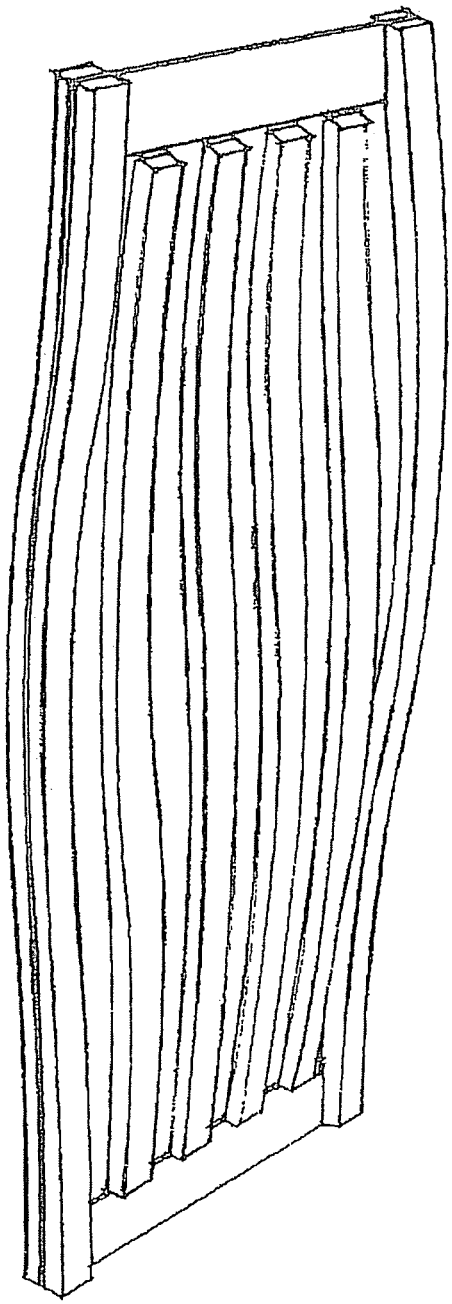
FIG. 15 is a perspective view showing the deformation of a reinforced rectangular flat metal plate of the invention accompanying torsion.

FIG. 15 shows the transition of the entire wall plate, which is caused by the progress of shear deformation after shear yield, in the analysis simulation of the first embodiment showing the typical structure of a rectangular metal wall plate. A case where a shear force is applied in the horizontal direction along upper and lower edges of a wall plate and a case where a flat plate is twisted correspond to the same mechanical system, and this is found out from a case where the entire flat plate is twisted and deformed. Accordingly, it is considered that the reinforcement structure according to the invention easily increases the torsional rigidity and torsional strength of a flat plate and is simple in terms of a building structure and advantageous in terms of the execution of building work without the necessity of the restriction of side edges in the long side direction.

REFERENCE SIGNS LIST

1: flat metal plate subjected to in-plane shear
2: square tube-like members spliced on the surface of a flat plate
3: square tube-like members provided along side edges in a long side direction
4: rectangular section members provided along both side edges of a flat plate
5: lateral reinforcing member of a middle portion in a longitudinal direction
6: force applying reinforcement jigs provided at both end portions of a flat plate

The invention claimed is:

1. A reinforcement structure of a rectangular flat metal plate, wherein strip-like rectangular section members are spliced on one surface of the flat plate along side edges of the flat plate, which is predominantly subjected to in-plane shear and supports a compressive load as necessary, in a longitudinal direction so as to reinforce the flat metal plate that is subjected to in-plane shear, a plurality of square tube-like members are parallelly arranged for each constant interval in a shorter side direction of the flat plate, and are spliced on the other surface of the flat plate, and the torsional rigidity and torsional strength of the rectangular flat metal plate are increased to ensure a yield shear load, and shear yield strength is stably maintained even in the transition of shear deformation after yield.

2. A reinforcement structure of a rectangular flat metal plate, wherein strip-like rectangular section members are spliced on one surface of the flat plate along side edges of the flat plate, which is predominantly subjected to in-plane shear and supports a compressive load as necessary, in a longitudinal direction so as to reinforce the flat metal plate that is subjected to in-plane shear, a plurality of C-shaped section members, semicircular tube-like members, or the like are spliced in a shorter side direction of the flat plate on the other surface so as to form a tube-like cavity portion on the flat plate and have substantially the same mechanical characteristics as a square tube-like member, and the torsional rigidity and torsional strength of the rectangular flat metal plate are increased to ensure a yield shear load, and shear yield strength is stably maintained even in the transition of shear deformation after yield.

3. The reinforcement structure of a rectangular flat metal plate according to claim 1 or 2, wherein the square tube-like members are parallelly arranged in the longitudinal direction of the rectangular flat metal plate, which is subjected to in-plane shear and supports a compressive load as necessary, so that a substantive difference is generated between the thickness of a portion on which the member is spliced and the thickness of a portion on which the member is not spliced, a width-thickness ratio of the strip-shaped area in the shorter side direction is 60 or less as for a steel material and is 40 or less as for a light metal material since a shear yield area is limited to a thin strip-shaped area at an early yield time, and an elastic area is made to remain within the surface of the flat plate in the form of a layer so that mechanical characteristics are stably maintained even in the changes of elastic and plastic rigidities.

4. The reinforcement structure of a rectangular flat metal plate according to claim 1 or 2, wherein reinforcing jigs, which apply a shear force, provided on both end portions of the rectangular flat metal plate, which is predominantly subjected to in-plane shear and supports a compressive load as necessary, in a longitudinal direction and the square tube-like members spliced on the flat plate are not integrated with a small gap interposed therebetween, and are subjected to transition without hindering the progress of the shear deformation of the flat plate, so that an excessive strength increase exceeding shear yield strength is prevented even in the growth of shear deformation after the shear yield of the rectangular flat metal plate and shear yield strength after the yield is stably maintained.

5. The reinforcement structure of a rectangular flat metal plate according to claim 1 or 2, wherein the cross-sections of strip-like rectangular section members or square tube-like members, which suppress rotational deformation to the outside of the flat plate at load application portions in the vicinity of both upper and lower end portions of a rectangular flat metal plate that is predominantly subjected to in-plane shear and supports a compressive load as necessary, allow deformation to the outside of both side edge portions of the flat plate in a long side direction without restricting the torsional deformation of the flat plate, which occur from basic mechanical balance by in-plane shear, and are spliced on both side edge portions of the flat plate in the longitudinal direction, are increased in size so as to suppress the torsional deformation of the flat plate to a low level and ensure mechanical stability.

6. The reinforcement structure of a rectangular flat metal plate according to claim 1 or 2, wherein at both ends of the rectangular flat metal plate in the shorter side direction, the strip-like rectangular section member and the square tube-like member face each other with the rectangular flat metal plate interposed therebetween.

* * * * *

UNITED STATES PATENT AND TRADEMARK OFFICE

CERTIFICATE OF CORRECTION

PATENT NO. : 8,615,969 B2
APPLICATION NO. : 13/634575
DATED : December 31, 2013
INVENTOR(S) : Toshiro Suzuki It is certified that error appears in the above-identified patent and that said Letters Patent is hereby corrected as shown below:

In the Specification

Column 9, line 13, change "angle $\phi$" to -- angle $\varphi$ --;

Column 9, line 14, change "angle $\phi$" to -- angle $\varphi$ --;

Column 10, line 38, change "$\tau^{cr}$" to -- $\tau_{Cr}$ --.

Signed and Sealed this
Twenty-sixth Day of August, 2014

Michelle K. Lee

Michelle K. Lee
*Deputy Director of the United States Patent and Trademark Office*